US005676029A

United States Patent [19]

Putsch

[11] Patent Number: 5,676,029

[45] **Date of Patent: *Oct. 14, 1997**

[54] PLIERS WITH TWO PLIER ARMS

[75] Inventor: Ral Putsch, Wuppertal, Germany

[73] Assignee: Knipex-Werk C. Gustav Putsch, Wuppertal, Germany

[ * ] Notice: The term of this patent shall not extend beyond the expiration date of Pat. No. 5,461,951.

[21] Appl. No.: 524,298

[22] Filed: Sep. 5, 1995

Related U.S. Application Data

[63] Continuation of Ser. No. 178,585, Jan. 7, 1994, Pat. No. 5,461,951, which is a continuation of Ser. No. 922,045, Jul. 29, 1992, abandoned.

[30] Foreign Application Priority Data

Aug. 8, 1991 [DE] Germany ..... 9109830 U
Nov. 7, 1991 [DE] Germany ..... 9113870 U

[51] Int. Cl.[6] ..... B25B 7/04
[52] U.S. Cl. ..... 81/412; 81/394
[58] Field of Search ..... 81/394, 405–413

[56] References Cited

U.S. PATENT DOCUMENTS 1,885,895 11/1932 Carey .
4,581,960 4/1986 Putsch et al. ..... 81/411
4,773,288 9/1988 Jang et al. ..... 81/412 X

FOREIGN PATENT DOCUMENTS 805265 3/1951 Germany ..... 81/411
10112 of 1912 United Kingdom .

*Primary Examiner*—James G. Smith
*Attorney, Agent, or Firm*—Martin A. Farber

[57] ABSTRACT

The invention relates to pliers (1) having two plier arms (2, 3) which are connected to each other by a pivot pin (4), the plier jaw (M) being formed above the region of intersection and grip sections (7, 8) being formed on the plier arms (2, 3) below the region of intersection, the one plier arm (2) which is adjustable stepwise relative to the other plier arm (3) within the region of intersection in order to change the size of the plier jaw (M) passing through a free space (F) in the other plier arm (3); furthermore the pivot pin (4) being guided in fitted manner within a bore hole (14) of the other plier arm (3) and can be shifted transverse to the longitudinal plane of the pliers and has two cross-sectional regions adjacent to each other in the axial direction of the pivot pin (4), one of which, in the coupled condition, comes into form-locked engagement with the profiled flanks (slot flanks 12) of a slot (11) (lying within the region of intersection) of the one plier arm (2) and the thinner cross-sectional region being freely displaceable within the slot (11). For a development which is favorable in handling, the invention proposes that the other plier arm (3) be developed on one side, on the actuation side of the pivot pin (4), with a recess (22) within which the pivot-pin head (15) can be received upon actuation and that an actuating stop which lies depressed in depth is provided for the pivot-pin head (15).

15 Claims, 12 Drawing Sheets

FIG.5
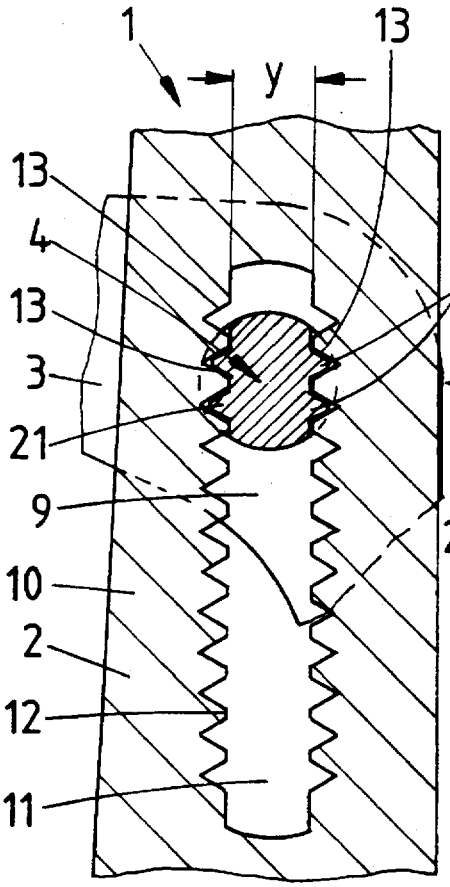
FIG.4
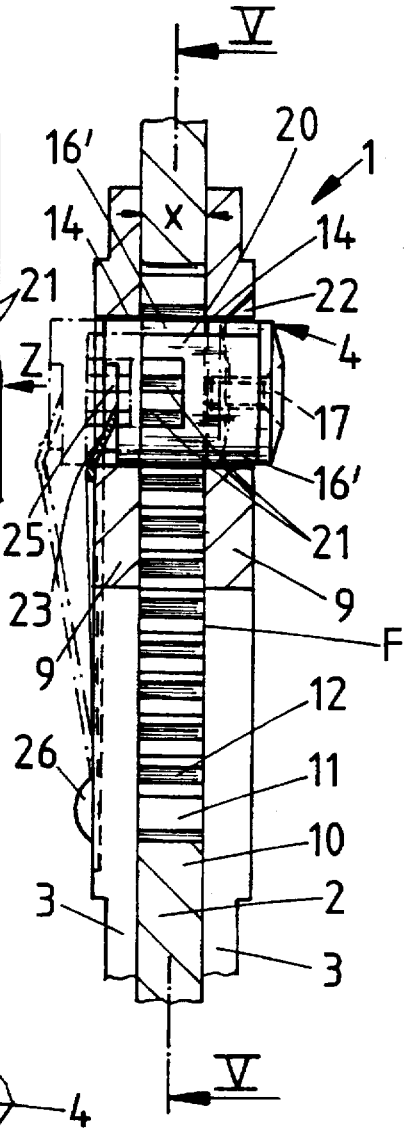
FIG.6
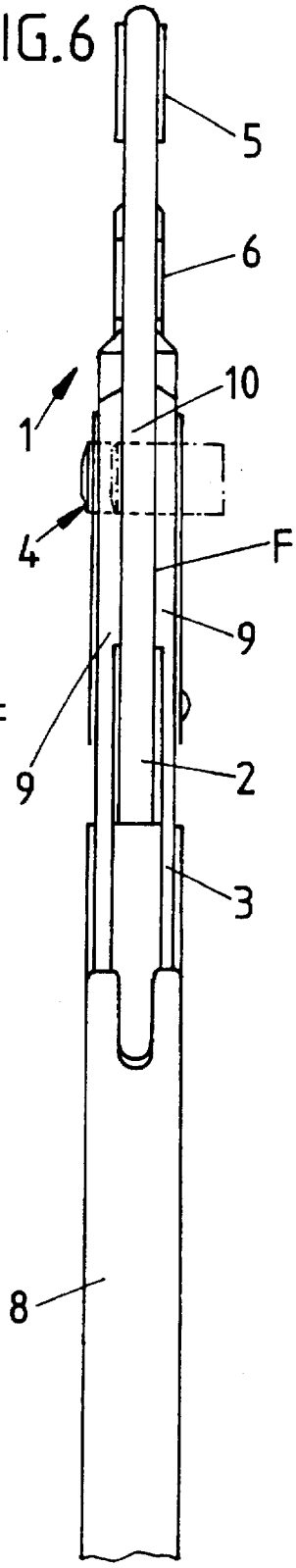
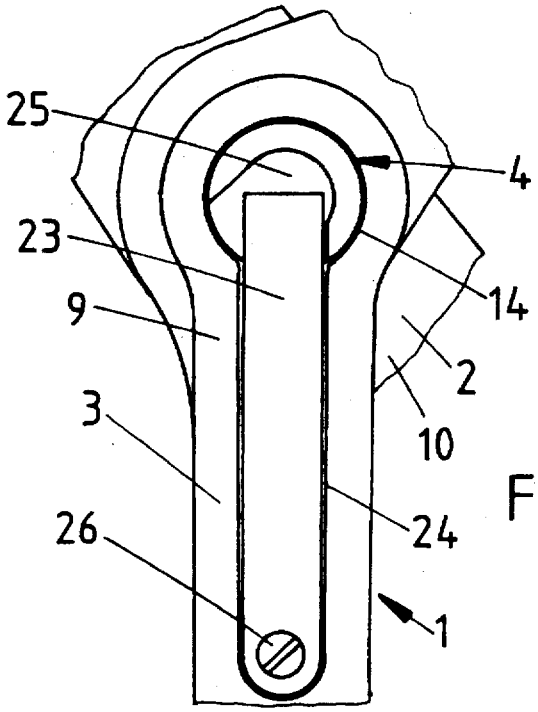
FIG.7

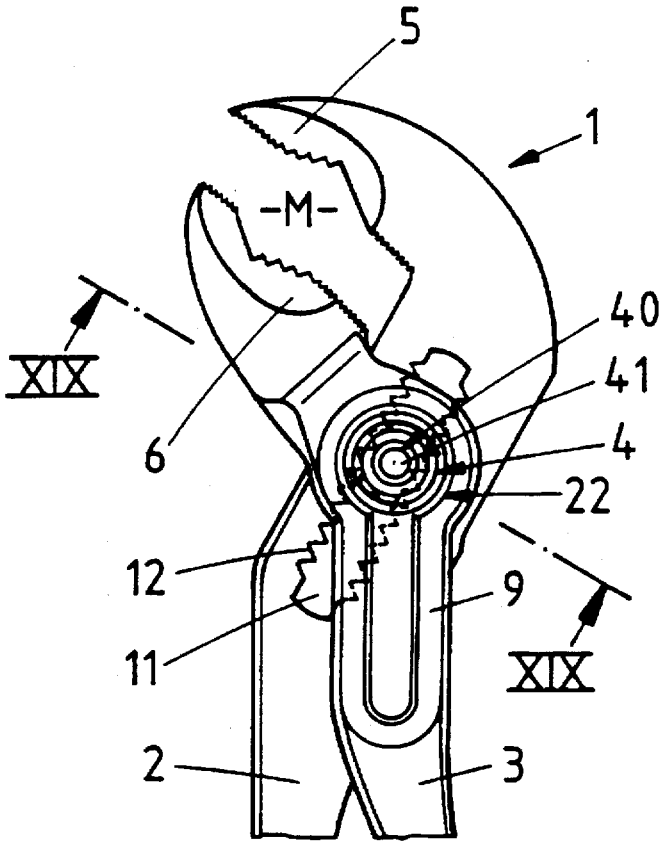
FIG.18
FIG.19
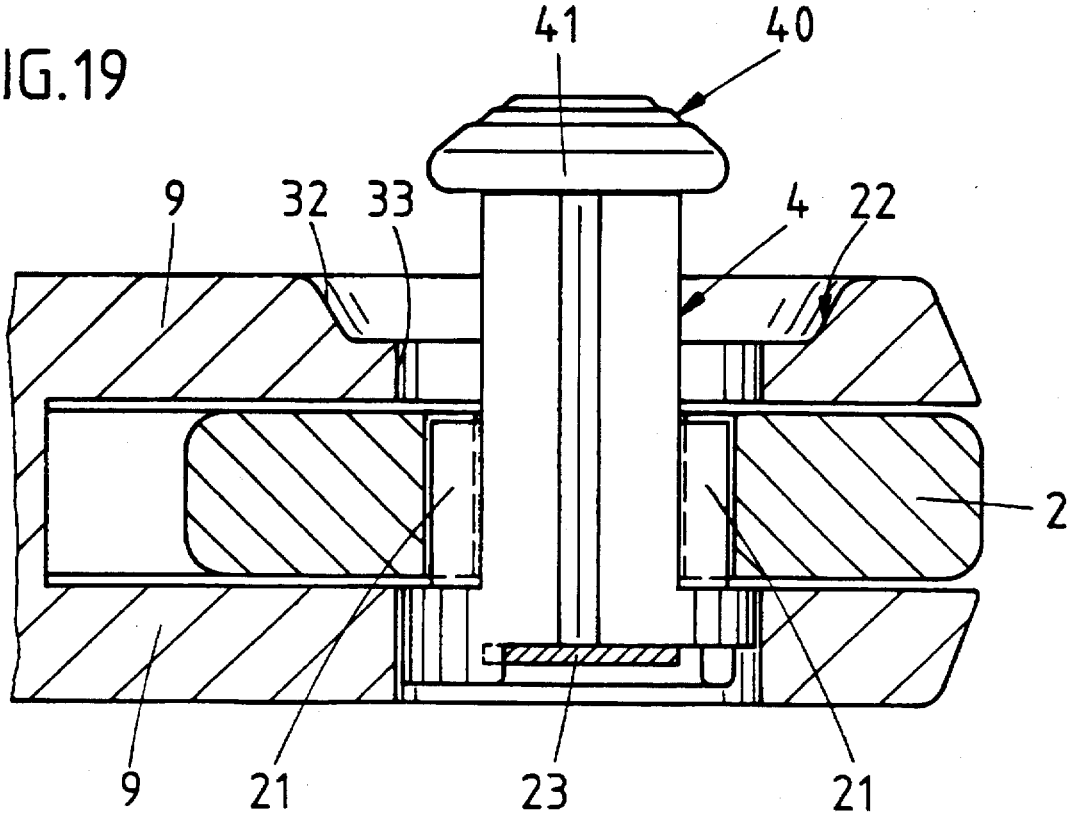

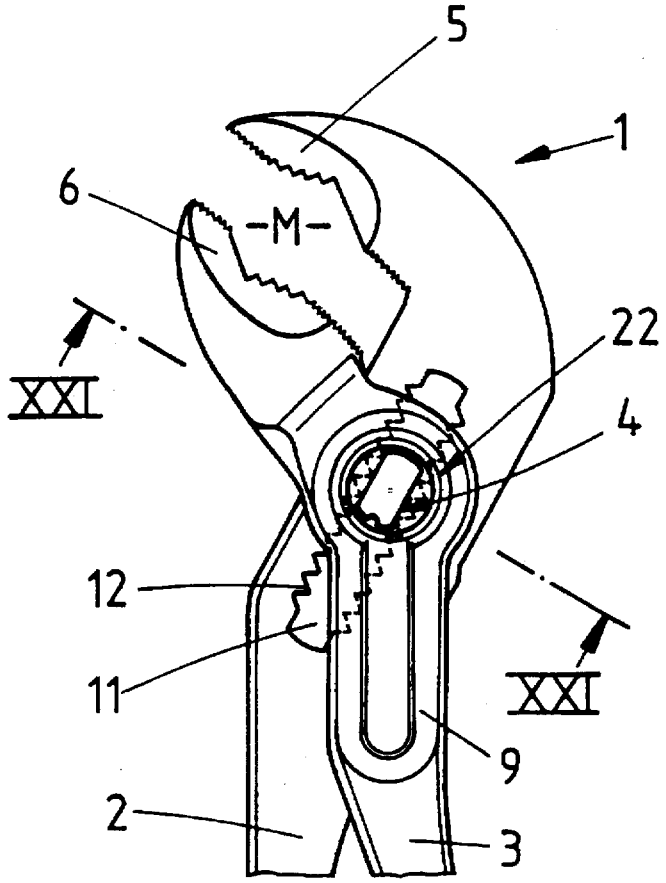
FIG.20
FIG.21
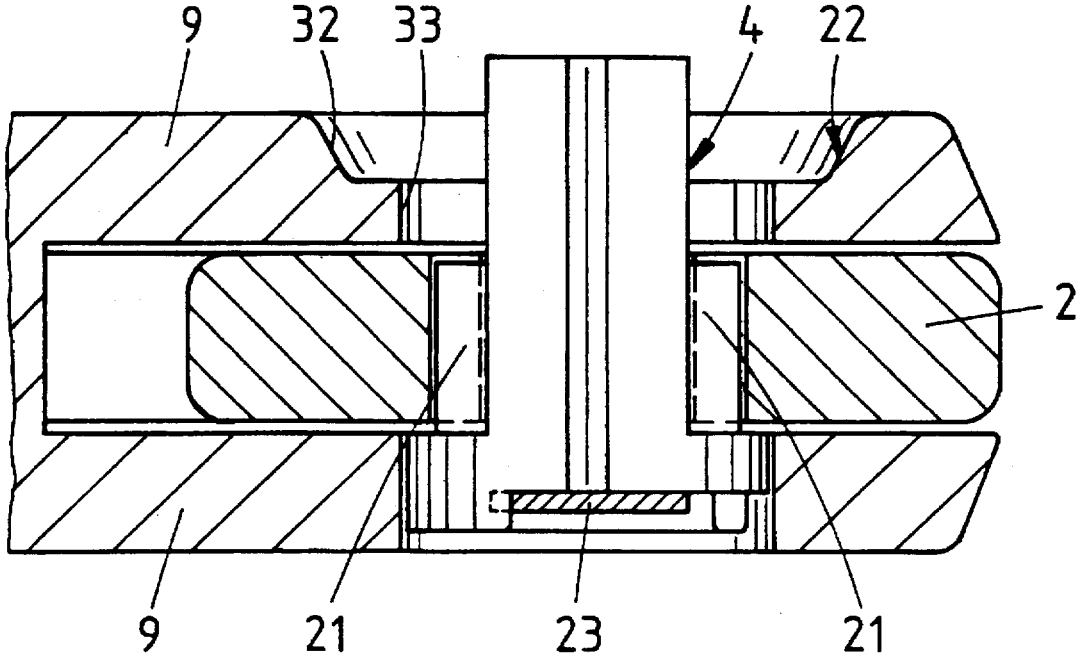

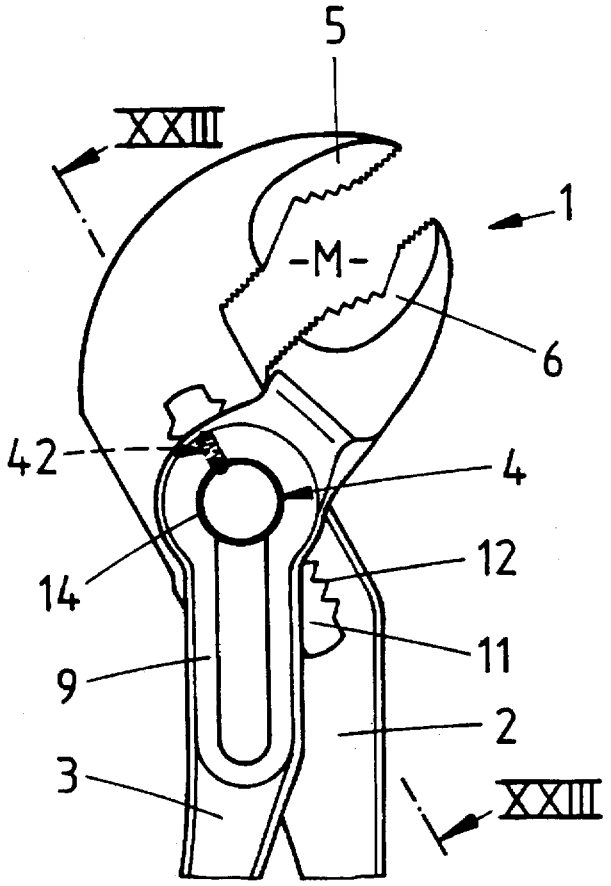
FIG.22
FIG.23
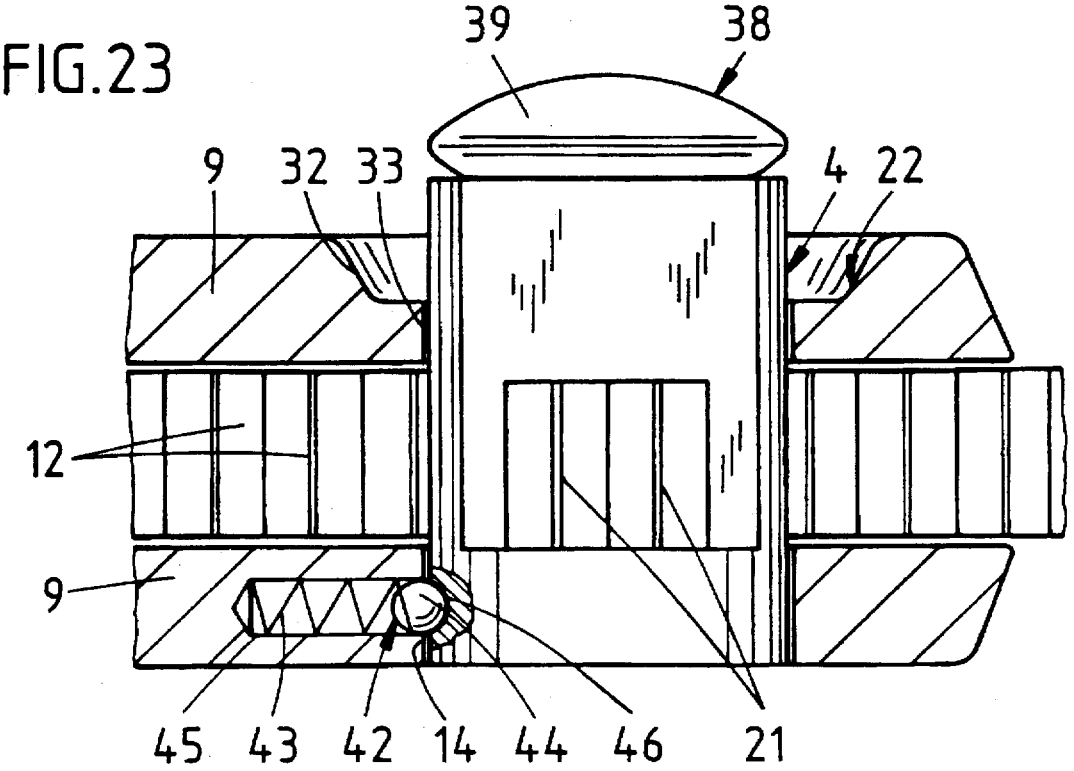

PLIERS WITH TWO PLIER ARMS

RELATED APPLICATIONS

This application is a continuation of my application Ser. No. 08/178,585 filed Jan. 7, 1994, now U.S. Pat. No. 5,461,951 which in turn is a continuation application of my application Ser. No. 07/922,045 filed Jul. 29, 1992 (now abandoned).

FIELD AND BACKGROUND OF THE INVENTION

The present invention relates to pliers having two plier arms which are connected to each other, the plier jaw being arranged above the region of intersection and grip sections being developed on the plier arms below the region of intersection, the one plier arm which is adjustable stepwise relative to the other plier arm in the region of intersection in order to change the size of the jaw of the pliers passing through a free space in the other plier arm, the pivot pin being guided in fitting manner in a bore hole in said other plier arm and being displaceable transverse to the longitudinal plane of the pliers and having two cross-sectional regions which are adjacent in the axial direction of the pivot pin, one of which regions, in coupled condition, enters into form-locked engagement with the profiled flanks of a slot (located within the region of intersection) in said one plier arm, and the thinner cross-sectional region being displaceable freely within said slot.

Pliers developed in this manner are known from EP 011 63 05 (corresponding to U.S. Pat. No. 4,581,960), the pivot pin being formed of a profiled cross-sectional region for form-locked engagement in correspondingly developed flanks of a plier arm and of a substantially thinner cross-sectional region. On its end there is developed on the thinner cross-sectional region a stop collar which, upon actuation of the pivot pin in axial direction, strikes against an outer side, facing it, of another plier arm.

SUMMARY OF THE INVENTION

As a result of the developement of the invention, pliers of this type are created which are of particularly increased value in use and in which, upon actuation of the pivot pin, the latter is stopped in the region of the profiled flanks of the one plier arm. In this connection, one proceeds in the manner that the plier arm having the free space for the passage of said one plier arm has a recess which is arranged on the actuation side of the pivot pin and which, upon actuation of the pivot pin, receives the head of the pivot pin, and that an actuation stop lying sunken in depth is provided for the pivot pin head. The structural means are simple and suitably developed. In this connection, it is particularly of advantage that the head of the pivot pin comes below the plane of the side of the plier arm having the recess upon actuation. In the basic position, the head of the pivot pin extends only slightly above the plane of the side of the plier arm having the recess, which facilitates finding the head of the pivot pin. The profiled flanks of the one plier arm are in this connection preferably developed as a stop. Spring loading of the pivot pin from the side opposite the head of the pivot pin is particularly advantageous in this connection, the pivot pin, after adjustment of the size of the jaw of the pliers, being always shifted back into its basic position. Thus, in the basic position, there is always a form-lock between the pivot pin and the plier arm which has the profiled flanks. As an alternative to this, the arrangement can also be such that the pivot pin can be adjustably locked by a detent part which acts substantially perpendicular to the direction of displacement of the pin, whereby the basic position of the pivot pin is defined. Displacement of the pivot pin in order to change the size of the jaw of the pliers is thus effected against the action of a detent part which may be provided in the region of the plier arm having the recess. Backward displacement of the pivot pin is effected in this connection by willful action, the pin being manually pushed back until held fast by the detent part. The detent part is advantageously developed as a spring-loaded ball which engages into a corresponding depression in the pivot pin. As further advantageous development, the pivot pin has an intermediate section between the cross-sectional region which produces the form lock and the head of the pivot pin, this intermediate section being of constant cross section. In this connection, the cross-section of the intermediate section preferably corresponds to the inside distance between the profiled flanks of the one plier arm. Assurance is thus had that the pivot pin is always mounted in a turn-proof and tilt-proof manner, regardless of its axial position. The head of the pivot pin is in this connection developed in circumference substantially coinciding with an annular envelope surface of the pivot pin, with the result that the pivot pin, regardless of its operating position, has a dependable mounting in the axial bore holes of the fork ends of the other plier arm. The recess arranged on the actuating side of the other plier arm is preferably developed in the shape of a funnel, this recess passing into the region of the axial bore hole. This development permits a favorable effecting of the displacement of the pivot pin in release position in order to change the inside size of the jaw of the pliers. It has proven particularly advantageous in this connection to develop the recess eccentrically to the head of the pivot pin, whereby the recess has an ergonomically more favorable shape, which results in improved handling upon the displacement of the pivot pin. This is further promoted by the fact that the recess is about thumb-size. The recess can also be slightly oval and, as mentioned already, be developed eccentric to the pivot pin. In this way, optimal rolling of the lower side of the thumb is made possible upon the displacement of the pivot pin. In order to avoid the slipping-off of the thumb upon actuation of a dirty (for instance, oil-covered) pivot pin, it is furthermore provided that the head of the pivot pin is structured on its top. The head is made easier to grip by this measure and thus easier to manipulate. As an alternative to this, the head of the pivot pin can also be developed as a round button part, spherically curved on top. In an advantageous further development, the head of the pivot pin, when depressed, substantially completely fills the opening in the recess. The head of the pivot pin thus has, in the projection, a diameter which corresponds to that of the opening in the recess. Furthermore, the head of the pivot pin is developed separately, which is advantageously effected in the manner that the head of the pivot pin is screwed onto the base-body of the pivot pin. Some other pinning connection can also be provided.

In accordance with a further embodiment, it is also contemplated that the recess provided in the other plier arm have such a free diameter, or the head of the pivot pin is developed in such a size with respect to the free diameter of the recess that even when the head of the first pin is depressed, a viewing slit remains on the profiled flanks of the one plier arm. This measure is advantageous, for instance, if dirt is present in the region of the profiled flanks of the one plier arm. The dirt can, in this way, for all practical purposes, not prevent the complete depressing of the actuating head. It is either forced away into the spaces in the tooth profilings which are opened up upon the pushing down of the head of the pivot pin or between the edge of the head of the pivot pin and the edge of the surrounding recess. For this purpose, it is furthermore advantageous that the head of the pivot pin in the projection covers, in the region of its largest diameter, a tooth of the flanks of the plier arm (only) to about one-half the depth of the tooth. The resting region of the head of the pivot pin on the upper transverse surface of the tooth profiling, which forms the stop for the head of the pivot pin upon the depression, is in this way kept very small. This is desirable for the pushing away of dirt in the sense indicated above. It is furthermore also preferred that the head of the pivot pin be developed in its base surface from the superimposing of a rounded surface and a rectangular surface, in such a manner that the width of the rectangle corresponds approximately to the free distance between the tooth flanks, while its length exceeds the diameter of the rounded surface. The section of the pivot pin or pivot-pin head which corresponds to the rectangular surface extends only within the free surface between the tooth flanks of the one plier arm. The rounded or circular surface is formed by the part of the pivot pin which also forms the protrusion with respect to the tooth profiling on the tooth flanks, which brings about the said stop upon depression. The narrow sides of the rectangular surface are furthermore preferably rounded. These narrow sides cooperate directly with the other plier arm in which the recess is formed. For this purpose, it is advisable that the radius of the circumferential line of the narrow sides correspond approximately to the radius of the recess. In order, in the depressed condition, to prevent also the head of the pivot pin moving below the other plier arm, which possibly might not be entirely out of the question in the case of pairings of unfavorable tolerance, it is also preferred that a protrusion of the rectangular surface above the circular surface in the profile—i.e. in height—extend above the adjoining circular section of the pivot head. This measure becomes particularly clear with respect to a concrete embodiment in which the circular section is formed by a separate, button-like structural part which has a spherically curved surface. The said protrusion extends above the edge region of this button-shaped part; in a side view, the button-like part, on the other hand, extends in its central region again above the projection or both projections.

BRIEF DESCRIPTION OF THE DRAWINGS

With the above and other advantages in view, the present invention will become more clearly understood in connection with the detailed description of preferred embodiments, when considered with the accompanying drawings, of which:

FIG. 4 is a section along the line IV—IV of FIG. 1 with the position of the pivot pin in released position shown in dash-dot line;

FIG. 5 is a section along the line V—V of FIG. 4;

FIG. 6 is a rear view of the pliers;

FIG. 7 is a side view of the region of intersection of the plier arms in order to make clear the arrangement of the leaf spring;

FIG. 18 is another partial showing corresponding to FIG. 16, but concerning another embodiment of the head of the pivot pin and of the recess of the one plier arm;

FIG. 19 is a section along the line XIX—XIX of FIG. 18;

FIG. 20 is a showing corresponding to FIG. 18, but concerning an embodiment in which the pivot pin is developed without a pivot-pin head;

FIG. 21 is a section along the line XXI—XXI of FIG. 20;

FIG. 22 is a rear view of the pliers of FIG. 2, but concerning another embodiment in which the pivot pin is held in the basic position by means of a detent part;

FIG. 23 is a section along the line XXIII—XXIII of FIG. 22; and

DETAILED DESCRIPTION OF THE PREFERRED EMBODIMENTS

Figure 1:
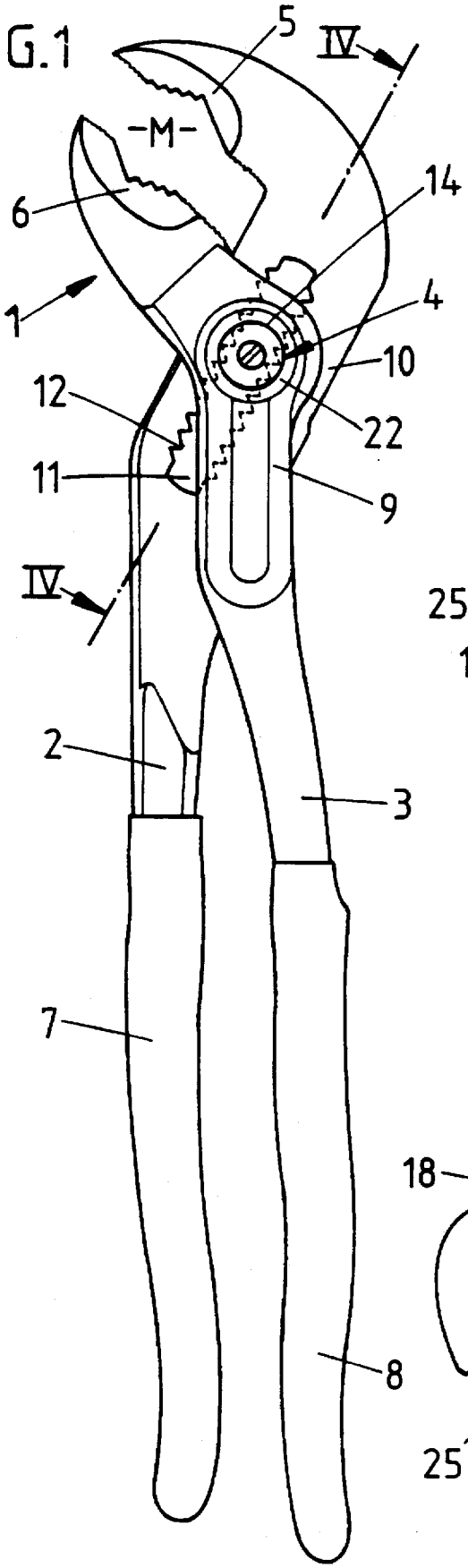
FIG. 1 is a side view of pliers in accordance with the invention.
Figure 2:
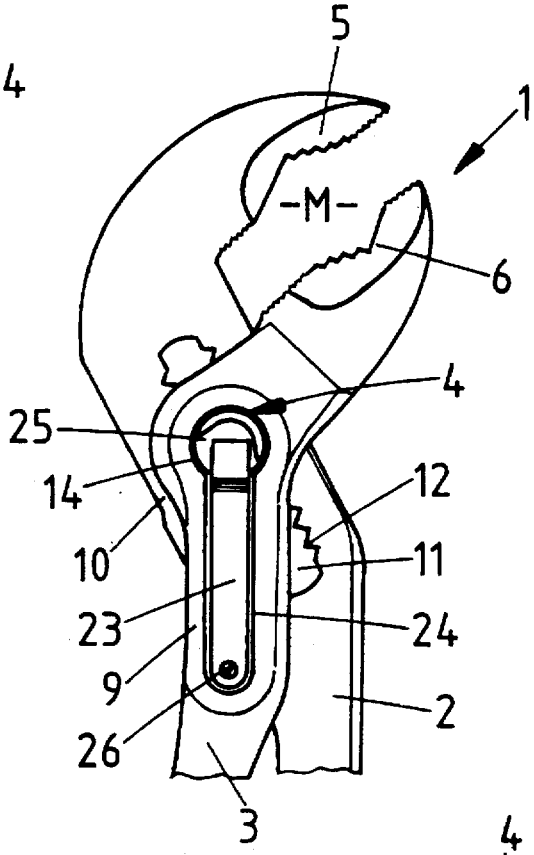
FIG. 2 shows the other side view of the pliers.

The plier 1 has two plier arms 2 and 3 which intersect each other. The plier arms are pivotally connected to each other by a pivot pin 4 in the region of intersection. The plier arms 2 and 3 form plier jaws 5 and 6 respectively on the side above the intersection region and handle grip sections 7 and 8 respectively on the side below the intersection region. The direction, generally parallel to the surfaces of the jaws 5, 6, of the gap of the mouth M of the plier jaws 5, 6 is oblique, about 45°, relative to the grip sections 7, 8. The grip sections are formed with gripping grooves or curves. The plier arm 2 passes through a free space F corresponding to its thickness in the plier arm 3. The free space F is developed as a slot lying in the plane of swing of the arm, the slot having on its two sides two arm longitudinal walls 9 of approximately the same thickness. These walls are of a greater width than that of the grip section.

The plier arm 2 also has in the region of the free space F a width which clearly exceeds the width of the grip section 7. This passage region is designated 10. It is approximately at a right angle to the plier jaw 5.

In order to change the size of the plier mouth M of the jaws 5, 6 the plier arm 3, through which the plier arm 2 extends, can be adjusted stepwise. The corresponding displacement means consists of a slot 11 which is passed through by the pivot pin 4 and is contained in the plier arm 2 which passes through the arm 3. The slot 11 is profiled on its slot flanks 12 which extend parallel to each other. The profiling is a saw-tooth profiling. The individual tooth gaps are designated 13 and extend, like the pivot pin 4, transverse to the plane of swinging actuation of the plier arms 2, 3.

The pivot pin 4 which is guided in fitting manner in a bore hole 14 which lies in coincidence with the slot 11 is developed, viewed axially, substantially with rotational symmetry. In this connection, pivot pin 4 consists of a cylindrically shaped pivot-pin head 15 and pivot-pin base part 16, the pivot-pin head 15 being attached firmly by a screw 17 to the pivot-pin base part 16. The two parts have substantially the same diameter. The pivot-pin base part 16 is symmetrically flattened on sides diametrically opposite each other, this region a being limited on the one side by the pivot-pin head 15 and on the other side by a pivot-pin collar 18 of the pivot-pin base part 16. The thickness of the pivot-pin base part 16 in the region a corresponds to the inside distance y of the slot 11 between the slot flanks 12, the length of the region a corresponding approximately to the sum of the width of the passage region 10 of the plier arm 2 and of an arm longitudinal wall 9 of the plier arm 3.

In the region of the section a of the pivot-pin base part there are formed on it, on each of the flattened sides 19, 20, two teeth 21 extending from the pivot-pin collar 18 for form-locked engagement in the tooth gaps 13 of the two slot flanks 12. The length of the teeth 21 corresponds in this connection approximately to three-fourths of the width x of the slot flanks 12.

The cross-sectional region a of the pivot-pin base part 16 which is developed in this manner thus serves, on the one hand, in order to obtain the form-lock between the pivot pin 4 and the plier arm 2 and, on the other hand, upon displacement of the pivot pin 4 in direction z, to secure the pivot pin 4 from turning on itself.

A recess 22 extending from the bore hole 14 is arranged on the actuating side of the pivot pin 4 in the arm longitudinal wall 9 of the plier arm 3. This recess 22 is made in the form of a depression, leaving a residual section of the bore hole 14. The recess 22 is thus of circular development.

Figure 24:
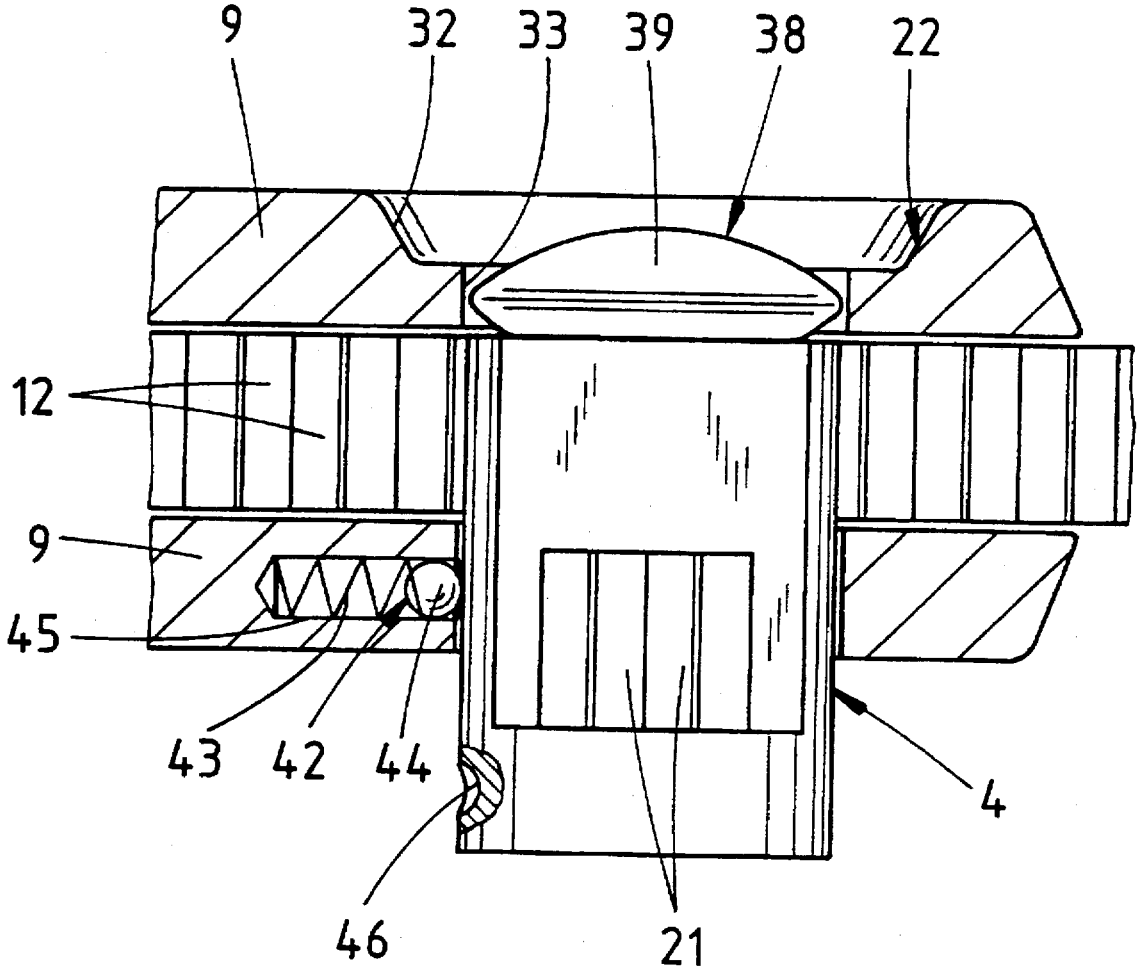
FIG. 24 is a showing corresponding to FIG. 23 but in the depressed position of the pivot pin.

Opposite the direction of displacement z, the pivot pin 4, with the exception of the embodiment shown in FIGS. 22–24, is under spring load, i.e. in the direction of maintaining the form-locked engagement of the profilings. For this purpose, the pivot pin 4 is acted on by a leaf spring 23 from the free end having a full cross section. The leaf spring is seated on the outside of the arm longitudinal wall 9 there. The region of association of the leaf spring 23 has, for its depressed arrangement, a trough 24 of corresponding shape. The leaf spring 23 assumes a course which is adapted to the plier arm 3, the end region of the leaf spring 23 being bent in the direction towards the pivot pin 4. As can be noted from FIG. 7, the free end of the leaf spring 23 grips over a sector-shaped depression 25 on the end-side of the pivot pin 4. The sector shape takes into account the need for the angle of swing of the plier arms 2, 3, with due consideration of the fact that, also in uncoupled (releaseable) condition, the pivot pin 4 is held non-turnably with respect to the plier arm 2 which bears the slot 11. A relative movement, i.e. turning of the pivot pin 4, takes place only with respect to the plier arm 3. For the fixing of the leaf spring 23 there is employed a screw 26 which passes through the other end, or some other fastening element.

In coupled position, the remaining circular sections 16' of the outer wall of the pivot-pin base part 16 form peripheral support or guide zones for the pivot pin 4 on the wall of the bore hole 14 of the arm longitudinal wall 9 on the right-hand side.

On the other side of the slot 11, and therefore the left-side arm wall 9, the full cylindrical outer wall of the pivot-pin base part 16, on the other hand, lies supported and guided on the wall of the bore hole 14.

In uncoupled (releaseable) position, the outer wall of the pivot-pin head 15 assumes the resting and guidance within the bore hole 14 of the right-hand arm longitudinal wall 9, and the outer wall sections 16' assume the supporting and guidance on the bore hole wall of the other side. Assurance is thus had that the pivot pin 4 is mounted in tilt-proof manner in every position.

The operation for adjusting the pliers is as follows:

In order to change the jaw opening previously used, it is merely necessary to shift the pivot pin 4 against spring action axially from the side having the pivot-pin head 15, i.e. transverse to the plane of movement of the plier arms 2, 3. The head 15 of the pivot pin is taken up by the recess 22 and with the striking of the pivot-pin head 15 against the profiled slot flanks 12 (the upper-end surface thereof) of the slot 11, the form-locked engagement between the teeth 21 of the pivot pin 4 and the tooth gaps 13 of the slot 11 is released. The pivot pin 4 can now be shifted, together with the plier arm 3, by displacing it in the lengthwise direction of the slot 11. Upon release of the pivot-pin head 15, the spring 23 effects the reestablishing of the desired form-locked engagement of the profilings, the pivot-pin collar 18 serving as a stop on the slot flanks A further embodiment of the pivot pin is shown in FIGS. 8 to 11. Insofar as identical parts are not separately mentioned, reference is had to what has been stated above.

The recess 22 or, more precisely, its smallest diameter d (in the case of a circular development as in the embodiment shown), which smallest diameter furthermore represents the free diameter, is so selected that when the pivot pin 4 is depressed, a viewing slot s (see also FIG. 9) remains on the profiled slot flanks 12. As can be noted, in particular, from the top view of FIG. 8, any particles of dirt present below the overlying region U of the button part 27 and the end surface 28 of the slot flank 12 can be pushed into the intermediate space 29 or ejected in upward direction.

Figure 8:
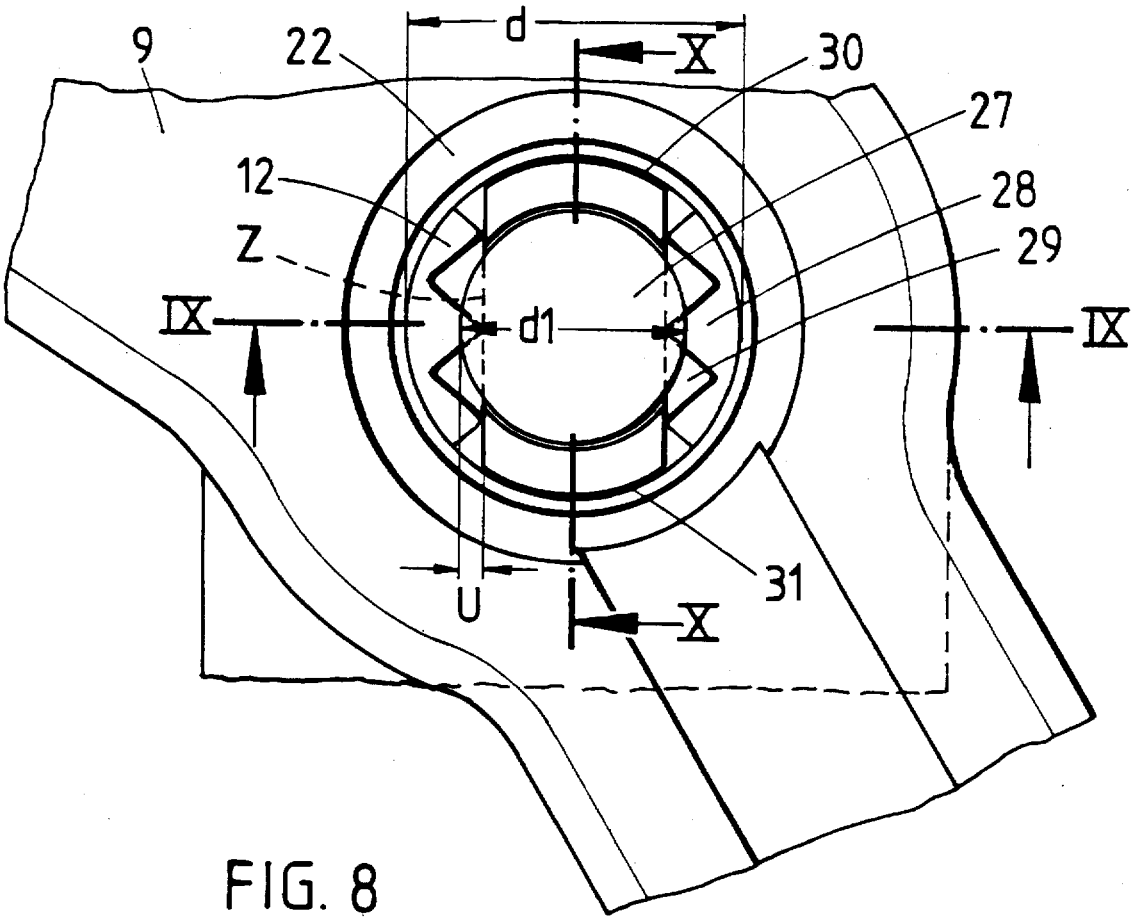
FIG. 8 is a top view, broken away, of another embodiment of the pivot pin.

As can also be noted in particular from FIG. 8, the button part 27 in the projection covers a tooth of the slot flanks 12 approximately to half-tooth depth in the region of its largest diameter d 1.

Figure 9:
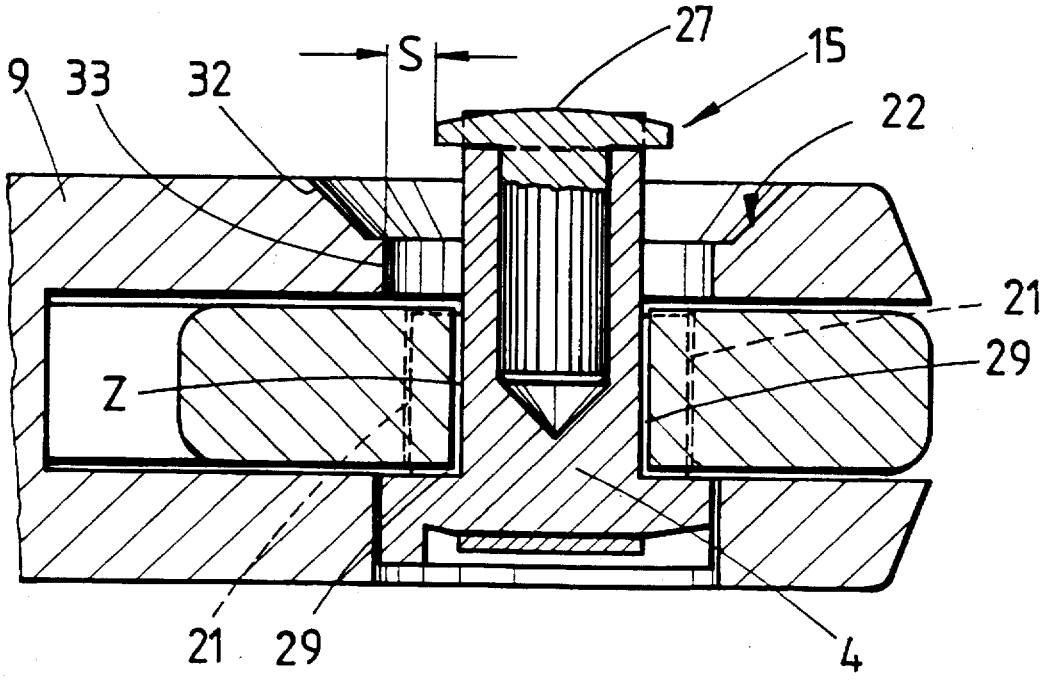
FIG. 9 is a section through the showing of FIG. 8, taken along the line IX—IX.
Figure 10:
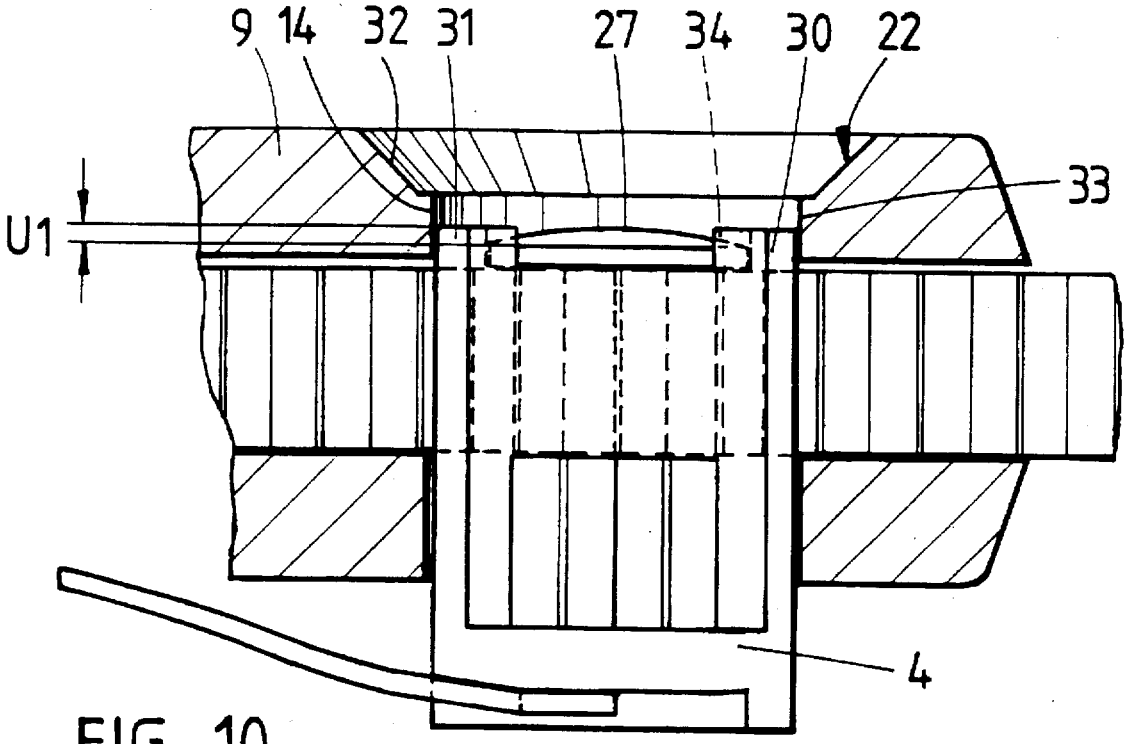
FIG. 10 is a further section through the showing of FIG. 8, taken along the line X—X, with the pivot pin depressed.
Figure 11:
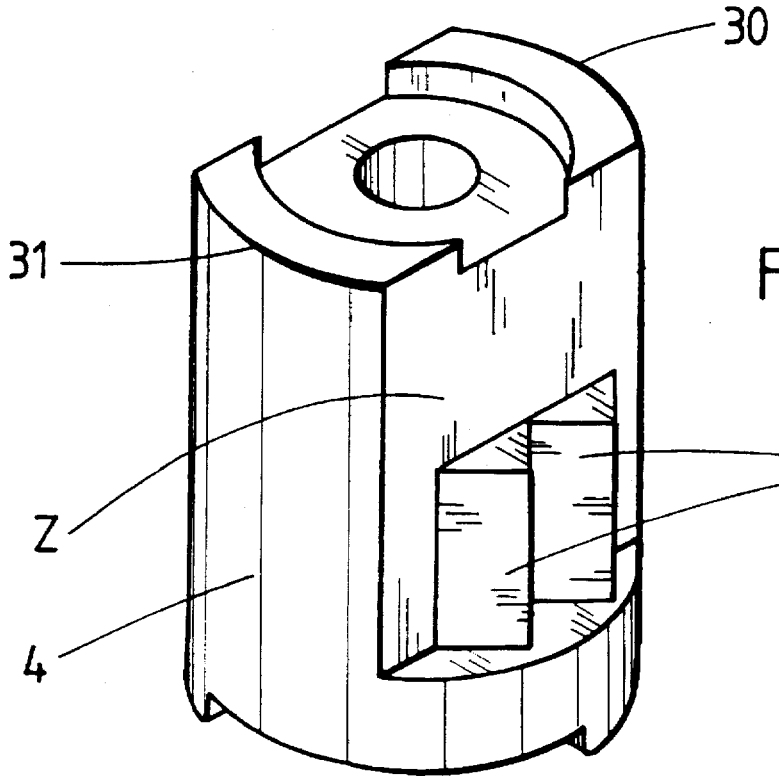
FIG. 11 is a perspective view, approximately corresponding to FIG. 3, of the pivot pin of the further embodiment, with the button part removed.

In the embodiment of FIGS. 8 to 11 the base surface of the pivot-pin head 15 consists of the superimposing of a rounded surface and a rectangular surface. As shown in FIG. 11, the side surfaces of the intermediate section Z of the pivot pin 4 are linear while the end surface (narrow sides) 30 and 31 are both curved. The side surfaces of the intermediate section Z are therefore those of a rectangular base surface while the end surfaces 30 and 31 are those of a circular base surface. The pivot pin 4 is thus a composite of these two structural forms. The rounded surface is formed by the separate button part 27. The superimposing is furthermore of such a nature that the width of the rectangle corresponds approximately to the free distance y between the slot flanks 12, while its length exceeds the diameter d 1 of the button part 27.

Furthermore, the narrow sides 30, 31 of the pivot-pin head 15 are rounded. The rounding of the narrow sides 30 and 31 of the pivot-pin head 15 corresponds here to the inner free rounding of the recess 22.

The recess 22 is formed specifically of a conical section 32 which has an angle of inclination of about 30°, and a cylindrical section (bore hole) 33.

As can be noted in particular from FIGS. 10 and 11 (the pivot pin 4 being shown in FIG. 11 without the button part 27), the narrow sides 30, 31 are extended upwards so that they extend in any event in the edge region in the profile view, i.e. in height, above the adjoining edge region 34 of the button part 27; protrusion U 1. The button part 27 is arranged in the pivot pin 4 countersunk with respect to the narrow sides 30, 31. In the depressed position shown also in FIG. 10 it is clear that this protrusion U 1 prevents the pivot-pin head 15 or an edge region 34 of the button part 27 from shifting, upon the displacement, below the bore hole 33 of the plier arm longitudinal wall 9.

Furthermore, in the case of the embodiment shown in FIGS. 9 to 11, the intermediate section Z between the cross-sectional region producing the form lock (teeth 21) and the pivot-pin head 15 of constant cross section continues still even in the region of the button part 27 and at least partially extends beyond it, namely on the narrow sides 30 and 31.

Figure 12:
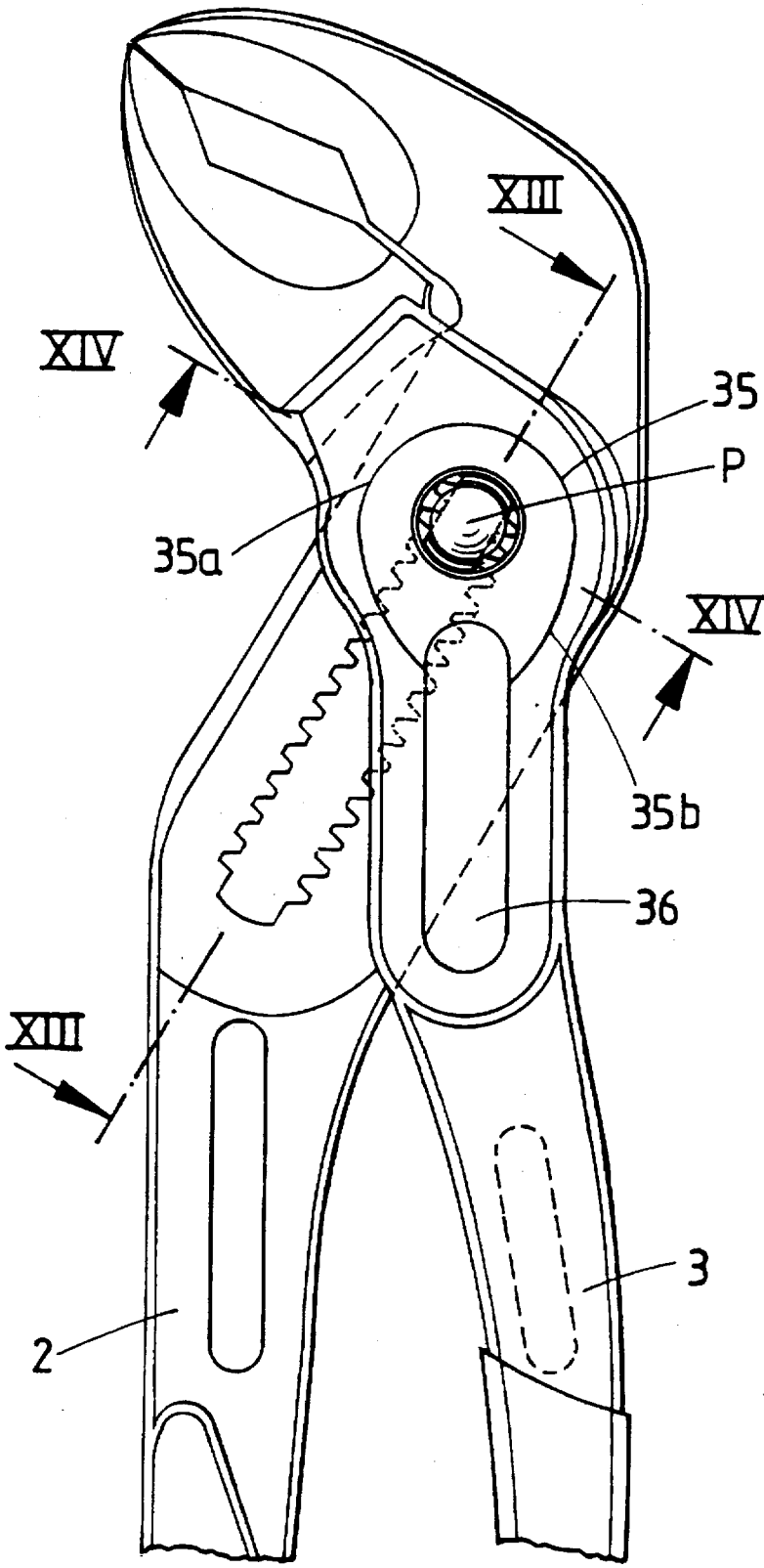
FIG. 12 is a partial showing according to FIG. 1 of an alternative embodiment.
Figure 13:
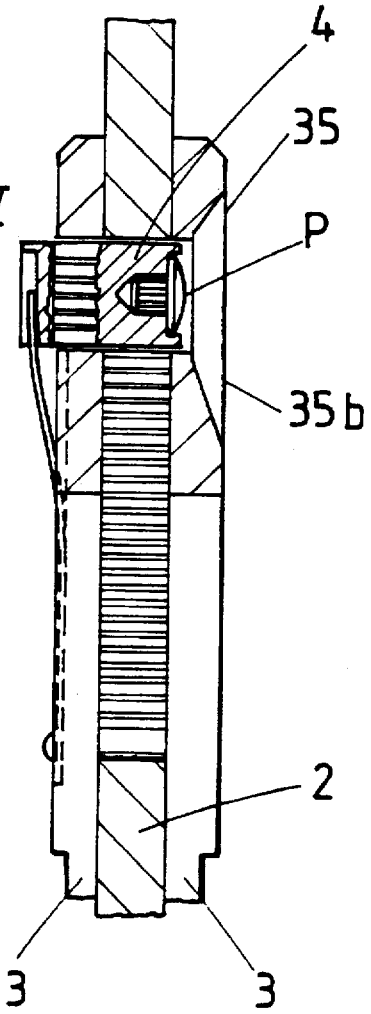
FIG. 13 is a section through the showing of FIG. 12, along the line XIII—XIII.
Figure 14:
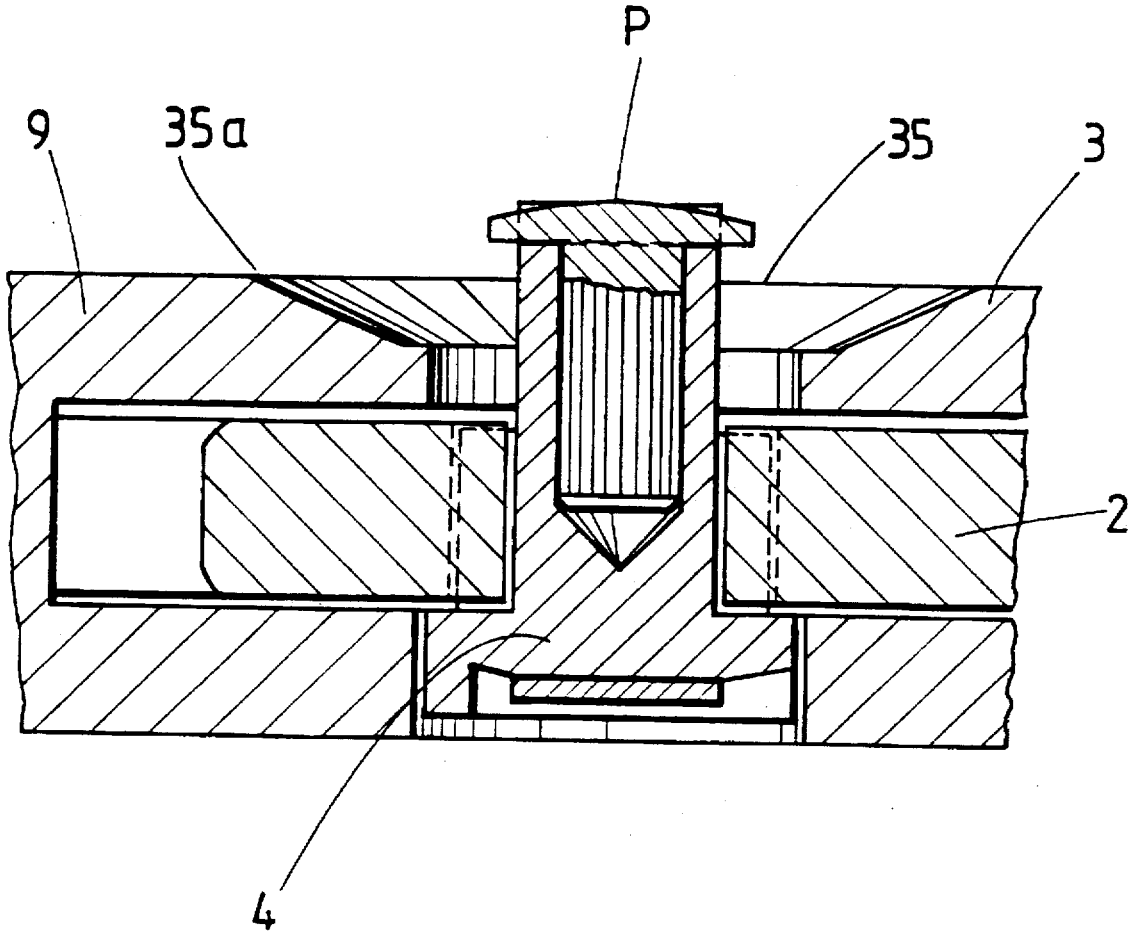
FIG. 14 is a section through the showing of FIG. 12, along the line XIV—XIV.

In FIG. 12 a modification is shown with respect to the recess 22 which surrounds the button part 27. In this case, the recess 22 is so developed as to result in an elliptical outer edge line 35. However, the ellipse is irregular insofar as the foci are produced by circles of different size and the ellipse is similar to a parabola **35*b* here in the lower region while in the upper region it is similar essentially to a precise semicircle arc 35*a*. In the upper region of the ellipse the button part 27 is concentric to a focus or center point of the semicircle arc 35*a***.

The limiting edge line 35 is furthermore not pronounced in the region of the strongest curvature of the parabola due to penetration by a slot 36 in the plier arm 3.

As a whole, however, there is obtained an ergonomically very favorable development of the recess which surrounds the button part 27. Furthermore, there is less tendency for dirt or the like possibly to attach itself. This recess can advantageously be produced by forging.

Figure 15:
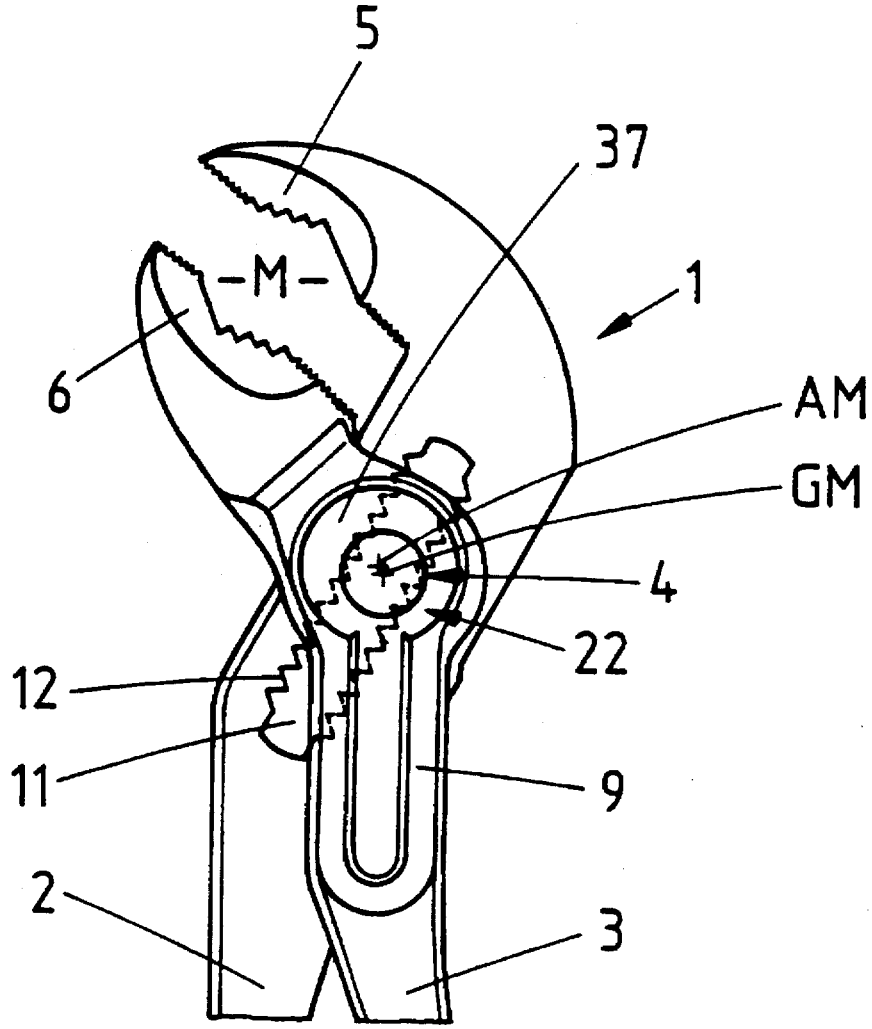
FIG. 15 is a partial showing in accordance with FIG. 1 of another alternative embodiment.

The recess 37 of the embodiment of the pliers 1 shown in FIG. 15 is precisely circular, the center point AM being eccentric to the center point GM of the pivot pin 4. In this case also, an ergonomically very advantageous shape of the recess 37 is obtained since, upon the displacement of the pivot pin 4, the latter offers an optimal resting surface for the ball of the thumb. It is also conceivable to make the recess 37 elliptical (similar to the recess shown in FIG. 12), in which case the upper region of the ellipse is arranged concentrically to the center GM of the pivot pin 4.

Figure 16:
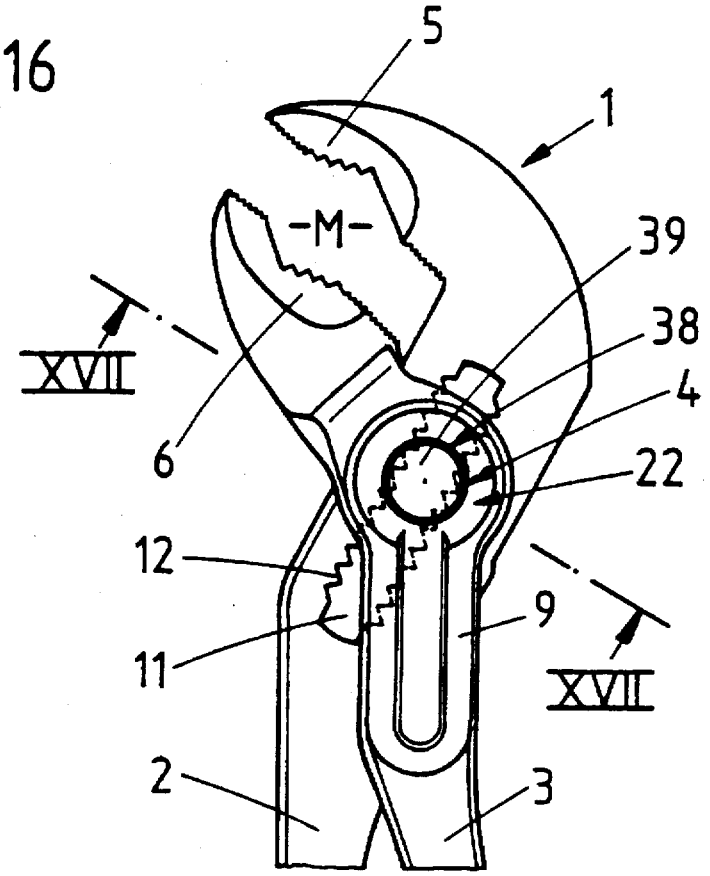
FIG. 16 is a showing corresponding to FIG. 15, but concerning another embodiment of the pivot pin and of the recess of the one plier arm.
Figure 17:
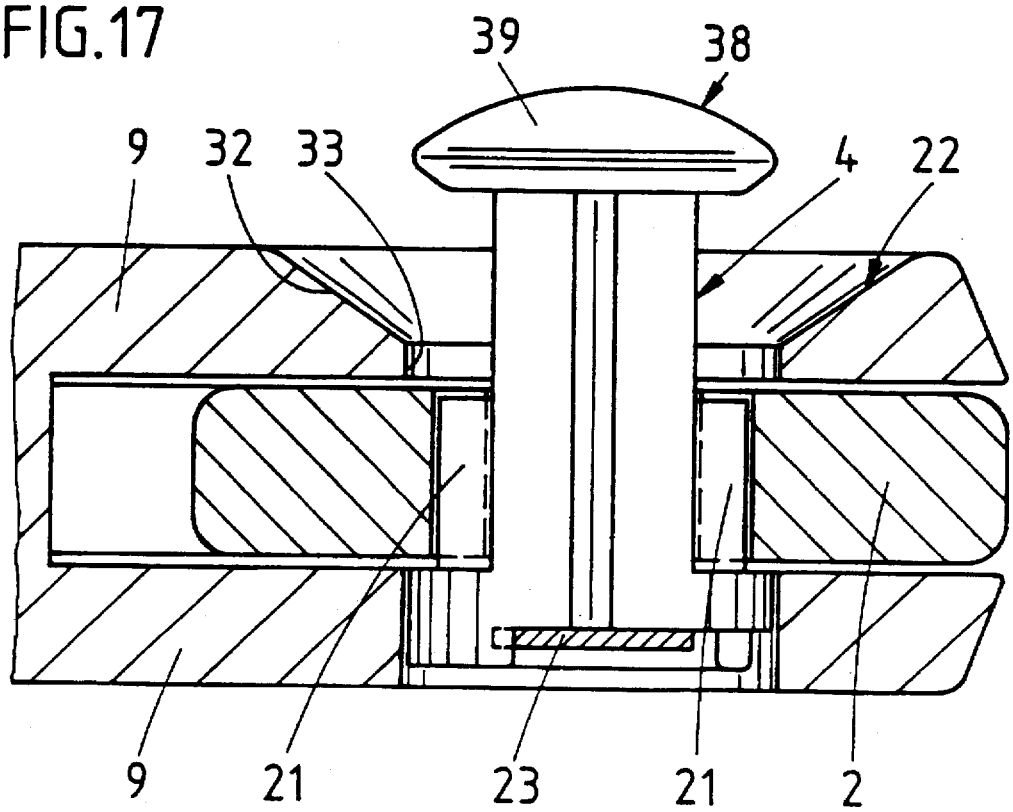
FIG. 17 is a section along the line XVII—XVII of FIG. 16.

In the embodiment shown in FIGS. 16 and 17 the pivot-pin head 38 is developed as a round button part 39 which is curved spherically on top. As can be noted in particular from FIG. 17, in this case also the recess 22 consists of a conical section 32 and a cylindrical section 33. Furthermore, in this embodiment the projection of the pivot-pin 38 when depressed substantially completely fills the cylindrical section (bore hole) 33 of the recess 22.

FIGS. 18 and 19 show a modification with respect to the shape of the pivot-pin head 40 and of the recess 22 which surrounds the pivot pin 4. The recess 22, as in the previous embodiments, has a conical section 32 and a cylindrical section 33, but the conical section 32 has an angle of inclination of about 60°. The pivot-pin head 40 is developed as a head part 40 structured on top. This structuring consists of a plurality of circular sections which are arranged concentrically and staggered vertically with respect to each other, so that a stepped pyramidal surface of the head part 41 is formed. This development of the head part 41 serves primarily for the secure handling of the pliers 1 upon change in the size of the plier jaw. Slipping of the thumb in the event of a dirty pivot-pin head 40 is thus successfully counteracted.

In the embodiments shown in FIGS. 15 to 19, the profiled flanks 12 form a stop limitation for the pivot pin 4 which is to be actuated, the latter resting via the lower side of the pivot-pin head 38 or 40 on the said slot flanks 12.

FIGS. 20 and 21, however, show an embodiment in which the pivot pin 4 does not have any of the pivot-pin heads which have been indicated in this case, a limitation of the path of displacement of the pivot pin 4 is established merely by the limited depth of depression of the actuating thumb. In this case also, the slot flanks 12 serve as stop limitation, the ball of the thumb corresponding to the bottom of a pivot-pin head.

The pivot pins 4 referred to in the previously indicated embodiments are all urged in the direction towards the basic position by the spring 23 from the side opposite the pivot-pin head.

An alternative to this is shown by the embodiments in FIGS. 22–24. In this case, the pivot pin 4 can be locked by a detent part 42 which acts perpendicular to the direction of displacement of the pivot pin 4. This detent part consists essentially of a compression spring 43 and a detent ball 44.

The compression spring 43 is arranged in a blind hole 44 open in direction towards the bore hole 14 in the arm longitudinal wall 9 opposite the recess 22, and it urges the ball 44 in direction towards the cylindrical end section of the pivot pin 4. The pivot pin 4 is provided in this region with a corresponding depression 46 for the entrance of the ball 44 in the basic position.

Figure 3:
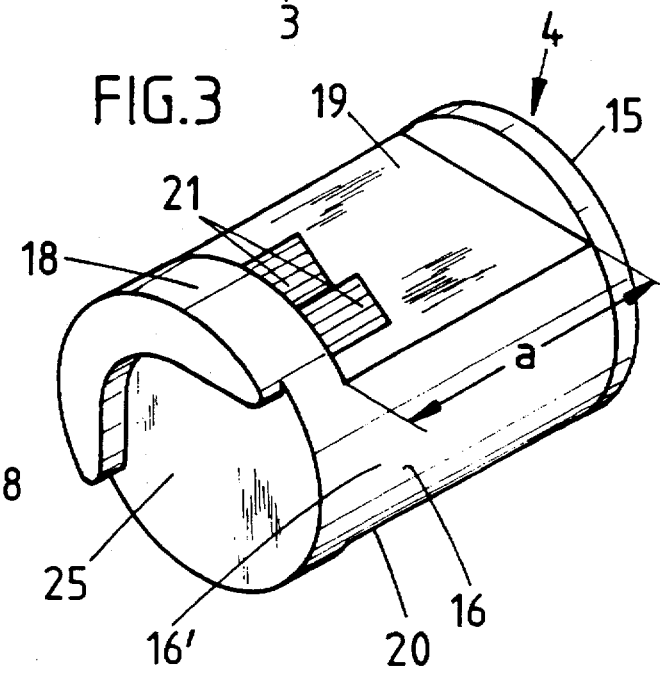
FIG. 3 shows the pivot pin in perspective.

The basic position of the pivot pin 4 is thus unambiguously defined. Unintentional loosening of the form lock between the teeth 21 of the pivot pin 4 and the profiled slot flanks 12 is thus successfully counteracted. For the adjustment of the size of the plier jaw, the pivot pin 4 is displaced axially from the side bearing the pivot-pin head 38, the detent ball 44 coming out of engagement with the recess 46 (see FIG. 24). Displacement of the pivot pin 4 back into the basic position is effected in this embodiment manually by means of actuation by one's thumb. In this connection the pivot pin 4 is thus shifted back until the detent part 42 holds the pivot pin 4 fast. It is be understood that the term "head" or "head section" of the pivot pin 4 includes the various configurations of the head as shown in the figures of the various embodiments, such as e.g. the enlarged head 40 of FIG. 19, the head 38 of FIG. 23, the head 15 of the pin 4 in FIG. 3, and the upper end of the pin 4 in FIG. 21 upon which a person places his or her thumb.

What is claimed is:

1. In a pliers having a pivot pin, and first and second plier arms which intersect in a region of intersection and are connected to each other by means of the pivot pin in the region of intersection, the arms having plier jaws respectively above the region of intersection and having grip sections below the region of intersection, wherein said first plier arm is displaceable stepwise relative to said second plier arm in said region of intersection in order to change spacing of the plier jaws with respect to each other, the first plier arm passing through a free space in said second plier arm, said pivot pin is guided in fitted manner in a hole in said second plier arm and is displaceable transverse to a longitudinal plane of the pliers, said longitudinal plane extending through both said plier arms, said first plier arm in said region of intersection is formed with a longitudinal slot with profiled flanks, said pivot pin has two adjacent cross-sectional regions in axial direction of the pivot pin, a first of said cross-sectional regions being in form-locked engagement with said profiled flanks of said slot in a coupled condition of said first and second plier arms, and a second of said cross-sectional regions is a thinner cross-sectional region and is freely displaceable in the slot in a releasable uncoupled condition of said first and second plier arms, said pivot pin at one end thereof has an actuating side serving as a head of the pivot pin, the improvement wherein said second plier arm is formed with a recess on an outer surface of a side of said second plier arm adjacent said actuating side of said pivot pin, said recess communicates with said hole in said second plier arm;

a surface of said recess is spaced apart with substantial spacing from the head of the pivot pin, and a pressed actuating condition of said pivot pin constituting said uncoupled condition constitutes an advancement position of the head of said pivot pin toward said first plier arm with the head depressed into said recess and past approximately said outer surface of said second plier arm; and the recess has a bottom disposed below the outer surface and, upon actuation of the pivot pin, the head of the pivot pin is lowerable into a region between the bottom and an outer edge line of the recess.

2. In a pliers having a pivot pin, and first and second plier arms which intersect in a region of intersection and are connected to each other by means of the pivot pin in the region of intersection, the arms having plier jaws respectively above the region of intersection and having grip sections below the region of intersection, wherein said first plier arm is displaceable stepwise relative to said second plier arm in said region of intersection in order to change spacing of the plier jaws with respect to each other, the first plier arm passing through a free space in said second plier arm, said pivot pin is guided in fitted manner in a hole in said second plier arm and is displaceable transverse to a longitudinal plane of the pliers, said longitudinal plane extending through both said plier arms, said first plier arm in said region of intersection is formed with a longitudinal slot With profiled flanks, said pivot pin has two adjacent cross-sectional regions in axial direction of the pivot pin, a first of said cross-sectional regions being in form-locked engagement with said profiled flanks of said slot in a coupled condition of said first and second plier arms, and a second of said cross-sectional regions is a thinner cross-sectional region and is freely displaceable in the slot in a releasable uncoupled condition of said first and second plier arms, said pivot pin at one end thereof has an actuating side serving am a head of the pivot pin, the improvement wherein said second plier arm is formed with a recess on an outer surface of a side of said second plier arm adjacent said actuating side of said pivot pin, said recess communicates with said hole in said second plier arm;

a surface of said recess is spaced apart with substantial spacing from the head of the pivot pin, and a pressed actuating condition of said pivot pin constituting said uncoupled condition constitutes an advancement position of the head of said pivot pin toward said first plier arm with the head depressed into said recess and past approximately said outer surface of said second plier arm; and the recess surface has a lower edge disposed below the outer surface and, upon actuation of the pivot pin, the head of the pivot pin is lowerable into a region between the lower edge and an outer edge line of the recess.

3. In a pliers having a pivot pin, and first and second plier arms which intersect in a region of intersection and are connected to each other by means of the pivot pin in the region of intersection, the arms having plier jaws respectively above the region of intersection and having grip sections below the region of intersection, wherein said first plier arm is displaceable stepwise relative to said second plier arm in said region of intersection in order to change spacing of the plier jaws with respect to each other, the first plier arm passing through a free space in said second plier arm, said pivot pin is guided in fitted manner in a hole in said second plier arm and is displaceable transverse to a longitudinal plane of the pliers, said longitudinal plane extending through both said plier arms, said first plier arm in said region of intersection is formed with a longitudinal slot with profiled flanks, said pivot pin has two adjacent cross-sectional regions in axial direction of the pivot pin, a first of said cross-sectional regions being in form-locked engagement with said profiled flanks of said slot in a coupled condition of said first and second plier ams, and a second of said cross-sectional regions is a thinner cross-sectional region and is freely displaceable in the slot in a releasable uncoupled condition of said first and second plier arms, said pivot pin at one end thereof has an actuating side serving as a head of the pivot pin, the improvement wherein said second plier arm is formed with a recess on an outer surface of a side of said second plier arm adjacent said actuating side of said pivot pin, said recess communicates with said hole in said second plier arm;

a surface of said recess is spaced apart with substantial spacing from the head of the pivot pin, and a pressed actuating condition of said pivot pin constituting said uncoupled condition constitutes an advancement position of the head of said pivot pin toward said first plier arm with the head depressed into said recess and past approximately said outer surface of said second plier arm; and upon actuation of the pivot pin, the head of the pivot pin passes into the recess and beyond said outer surface.

4. In a pliers having a pivot pin, and first and second plier arms which intersect in a region of intersection and are connected to each other by means of the pivot pin in the region of intersection, the arms having plier jaws respectively above the region of intersection and having grip sections below the region of intersection, wherein said first plier arm is displaceable stepwise relative to said second plier arm in said region of intersection in order to change spacing of the plier jaws with respect to each other, the first plier arm passing through a free space in said second plier arm, said pivot pin is guided in fitted manner in a hole in said second plier arm and is displaceable transverse to a longitudinal plane of the pliers, said longitudinal plane extending through both said plier arms, said first plier arm in said region of intersection is formed with a longitudinal slot with profiled flanks, said pivot pin has two adjacent cross-sectional regions in axial direction of the pivot pin, a first of said cross-sectional regions being in form-locked engagement with said profiled flanks of said slot in a coupled condition of said first and second plier arms, and a second of said cross-sectional regions is a thinner cross-sectional region and is freely displaceable in the slot in a releasable uncoupled condition of said first and second plier arms, said pivot pin at one end thereof has an actuating side serving as a head of the pivot pin, the improvement wherein said second plier arm is formed with a recess on an outer surface of a side of said second plier arm adjacent said actuating side of said pivot pin, said recess communicates with said hole in said second plier arm;

a surface of said recess is spaced apart with substantial spacing from the head of the pivot pin, and a pressed actuating condition of said pivot pin constituting said uncoupled condition constitutes an advancement position of the head of said pivot pin toward said first plier arm with the head depressed into said recess and past approximately said outer surface of said second plier arm; and the recess providing access to the head of the pivot pin.

5. A pliers according to claim 3, wherein, in the uncoupled condition of the pivot pin, the head of the pivot pin is depressed in a position in which an outer surface of the pin is adjacent to said outer surface of the second plier arm.

6. A pliers according to claim 3, wherein, in the uncoupled condition of the pivot pin, the head of the pivot pin is depressed in a position in which an outer surface of the pin is below the recess.

7. A pliers according to claim 4, wherein, upon said actuation of the pivot pin, the head of the pivot pin is depressed to a position in which an outer surface of the pin is adjacent to an outer edge line of the recess.

8. A pliers according to claim 4, wherein, upon said actuation of the pivot pin, the head of the pivot pin is depressed to a position in which an outer surface of the pin is below the recess.

9. In a pliers having a pivot pin, and first and second plier arms which intersect in a region of intersection and are connected to each other by means of the pivot pin in the region of intersection, the arms having plier jaws respectively above the region of intersection and having grip sections below the region of intersection, wherein said first plier arm is displaceable stepwise relative to said second plier arm in said region of intersection in order to change spacing of the plier jaws with respect to each other, the first plier arm passing through a free space in said second plier arm, said pivot pin extends through a hole in said second plier arm and is displaceable transverse to a longitudinal plane of the pliers, said longitudinal plane extending through both said plier arms, said first plier arm in said region of intersection is formed with a longitudinal slot with profiled flanks, said pivot pin has two adjacent cross-sectional regions in axial direction of the pivot pin, a first of said cross-sectional regions being in form-locked engagement with said profiled flanks of said slot in a coupled condition of said first and second plier arms, and a second of said cross-sectional regions is a thinner cross-sectional region and is freely displaceable in the slot in a releasable uncoupled condition of said first and second plier arms, said pivot pin at one end thereof has an actuating side serving as a head of the pivot pin, the improvement wherein said record plier arm has a recess extending from an outer surface of said second plier arm to said hole of said second plier arm, said recess encircling said pivot pin and facing outward front said pliers;

the head of said pivot pin advances via said recess toward said hole upon a displacement of said pivot pin to attain said uncoupled condition of said first and said second plier arms, the head being advanceable toward said first plier arm and past approximately said outer surface of said second plier arm;

said recess, as viewed in cross-section, has a conical section; and wherein said conical section has an inclination of approximately 30° relative to an axis of said pivot pin.

10. In a pliers having a pivot pin, and first and second plier arms which intersect in a region of intersection and are connected to each other by means of the pivot pin in the region of intersection, the arms having plier jaws respsctively above the region of intersection and having grip sections below the region of intersection, wherein said first plier arm is displaceable stepwise relative to said second plier arm in said region of intersection in order to change spacing of the plier jaws with respect to each other, the first plier arm passing through a free space in said second plier arm, said pivot pin extends through a hole in said second plier arm and is displaceable transverse to a longitudinal plane of the pliers, said longitudinal plane extending through both said plier arms, said first plier arm in said region of intersection is formed with a longitudinal slot with profiled flanks, said pivot pin has two adjacent cross-sectional regions in axial direction of the pivot pin, a first of said cross-sectional regions being in form-locked engagement with said profiled flanks of said slot in a coupled condition of said first and second plier arms, and a second of said cross-sectional regions is a thinner cross-sectional region and is freely displaceable in the slot in a releasable uncoupled condition of said first and second plier arms, said pivot pin at one end thereof has an actuating side serving as a head of the pivot pin, the improvement wherein said second plier arm has a recess extending from an outer surface of said second plier arm to said hole of said second plier arm, said recess encircling said pivot pin and facing outward front said pliers;

the head of said pivot pin advances via said recess toward said hole upon a displacement of said pivot pin to attain said uncoupled condition of said first and said second plier arms, the head being advanceable toward said first plier arm and past approximately said outer surface of said second plier arm;

said recess, as viewed in cross-section, has a conical section; and wherein said conical section has an inclination of approximately 60° relative to an axis of said pivot pin.

11. In a pliers having a pivot pin, and first and second plier arms which intersect in a region of intersection and are connected to each other by means of the pivot pin in the region of intersection, the arms having plier jaws respectively above the region of intersection and having grip sections below the region or intersection, wherein said first plier arm is displaceable stepwise relative to said second plier arm in said region of intersection in order to change spacing of the plier jaws with respect to each other, the first plier arm passing through a free space in said second plier arm, said pivot pin extends through a hole in said second plier arm and is displaceable transverse to a longitudinal plane of the pliers, said longitudinal plane extending through both said plier arms, said first plier arm in said region of intersection is formed with a longitudinal slot with profiled flanks, said pivot pin has two adjacent cross-sectional regions in axial direction of the pivot pin, a first of said cross-sectional regions being in form-locked engagement with said profiled flank of said slot in a coupled condition of said first and second plier arm, and a second of said cross-sectional regions is a thinner cross-sectional region and is freely displaceable in the slot in a releasable uncoupled condition of said first and second plier arms, said pivot pin at one end thereof has an actuating side serving as a head of the pivot pin the improvement wherein said second plier arm has a recess extending from an outer surface of said second plier arm to said hole of said second plier arm, said recess encircling said pivot pin and facing outward from said pliers;

the head of said pivot pin advances via said recess toward said hole upon a displacement of said pivot pin to attain said uncoupled condition of said first and said second plier arms, the head being advanceable toward said first plier arm and past approximately said outer surface of said second plier arm;

said recess, as viewed in cross-section, has a conical section; and wherein an outer edge line of said recess is a semicircle.

12. A pliers according to claim 11, wherein said semicircle is centered on an axis of said pivot pin.

13. A pliers according to claim 11, wherein said semicircle is offset from an axis of said pivot point.

14. In a pliers having a pivot pin, and first and second plier arms which intersect in a region of intersection and are connected to each other by means of the pivot pin in the region of intersection, the arms having plier jaws respectively above the region of intersection and having grip sections below the region of intersection, wherein said first plier arm is displaceable stepwise relative to said second plier arm in said region of intersection in order to change spacing of the plier jaws with respect to each other, the first plier arm passing through a free space in said second plier arm, said pivot pin extends through a hole in said second plier arm and is displaceable transverse to a longitudinal plane of the pliers, said longitudinal plane extending through both said plier arms, said first plier arm in said region of intersection is formed with a longitudinal slot with profiled flanks, said pivot pin has two adjacent cross-sectional regions in axial direction of the pivot pin, a first of said cross-sectional regions being form-locked engagement with said profiled flanks of said slot in a coupled condition of said first and second plier arms, and a second of said cross-sectional regions is a thinner cross-sectional region and is freely displaceable in the slot in a releasable uncoupled condition of said first and second plier arms, said pivot pin at one end thereof has an actuating side serving as a head of the pivot pin, the improvement wherein said second plier arm has a recess extending from an outer surface of said second plier arm to said hole or said second plier arm, said recess having a surface encircling said pivot pin with substantial spacing from said pivot pin and facing outward from said pliers;

the head of said pivot pin is advanced via said recess toward said hole in a depressed displacement actuating condition of said pivot pin constituting said uncoupled condition of said first and said second plier arms, the head being advanceable toward said first plier arm and past said outer surface of said second plier arm;

in said uncoupled condition, the head of said pivot pin is depressed into said recess advancing beyond said outer surface of said second plier arm, said recess being ergonomically shaped, and wherein an outer edge line of said recess is circular.

15. In a pliers having a pivot pin, and first and second plier arms which intersect in a region of intersection and are connected to each other by means of the pivot pin in the region of intersection, the arms having plier jaws respectively above the region of intersection and having grip sections below the region of intersection, wherein said first plier arm is displaceable stepwise relative to said second plier arm in said region of intersection in order to change spacing of the plier jaws with respect to each other, the first plier arm passing through a free space in said second plier arm, said pivot pin extends through a hole in said second plier arm and is displaceable transverse to a longitudinal plane of the pliers, said longitudinal plane extending through both said plier arms, said first plier arm in said region of intersection is formed with a longitudinal slot with profiled flanks, said pivot pin has two adjacent cross-sectional regions in axial direction of the pivot pin, a first of said cross-sectional regions being in form-locked engagement with said profiled flanks of said slot in a coupled condition of said first and second plier arms, and a second of said cross-sectional regions is a thinner cross-sectional region and is freely displaceable in the slot in a releasable uncoupled condition of said first and second plier arms, said pivot pin at one end thereof has an actuating side serving as a head of the pivot pin, the improvement wherein said second plier arm has a recess extending from an outer surface of said second plier arm to said hole of said second plier arm, said recess encircling said pivot pin and facing outward from said pliers;

the head or said pivot pin advances via said recess toward said hole upon a displacement of said pivot pin to attain said uncoupled condition of said first and said second plier arms, said recess having a configuration for reception of a thumb of a person using the pliers upon advancement of the head toward said first plier arm and past approximately said outer surface of said second plier arm;

a side of said recess has an inclination in the manner of a conic section to provide an opening of said recess which opens outward of said pliers for said reception of the thumb; and wherein an outer edge line of said recess is circularly.

* * * * *

UNITED STATES PATENT AND TRADEMARK OFFICE

CERTIFICATE OF CORRECTION

PATENT NO. : 5,676,029

DATED : Oct. 14, 1997

INVENTOR(S) : Ralf Putsch

It is certified that error appears in the above-identified patent and that said Letters Patent is hereby corrected as shown below:

On the Cover Page Item [75] Inventor: Change "Ral" to --Ralf--

Signed and Sealed this

Eighth Day of December, 1998

*Attest:*

*Attesting Officer*

BRUCE LEHMAN

*Commissioner of Patents and Trademarks*